US010066476B2

(12) United States Patent
Hoehn et al.

(10) Patent No.: US 10,066,476 B2
(45) Date of Patent: Sep. 4, 2018

(54) PHASE ESTIMATION FROM ROTATING SENSORS TO GET A TOOLFACE

(71) Applicant: Baker Hughes Incorporated, Houston, TX (US)

(72) Inventors: Oliver Hoehn, Hannover (DE); Andreas Peter, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 929 days.

(21) Appl. No.: 14/306,517

(22) Filed: Jun. 17, 2014

(65) Prior Publication Data

US 2014/0367170 A1 Dec. 18, 2014

Related U.S. Application Data

(60) Provisional application No. 61/836,488, filed on Jun. 18, 2013.

(51) Int. Cl.

| | |
|---|---|
| ***E21B 47/02*** | (2006.01) |
| ***E21B 47/024*** | (2006.01) |
| ***E21B 7/04*** | (2006.01) |
| ***E21B 7/06*** | (2006.01) |
| *E21B 47/022* | (2012.01) |

(52) U.S. Cl.

CPC ..... *E21B 47/024* (2013.01); *E21B 7/04* (2013.01); *E21B 7/06* (2013.01); *E21B 47/02* (2013.01); *E21B 47/02208* (2013.01)

(58) Field of Classification Search

CPC ..... E21B 47/024; E21B 47/02; E21B 4/00; E21B 7/08; E21B 7/04; E21B 47/022; E21B 7/06; E21B 47/02208; G01V 1/46; G01V 1/48; G01V 3/18

See application file for complete search history.

(56) References Cited

U.S. PATENT DOCUMENTS

| | | | |
|---|---|---|---|
| 4,813,274 | A | 3/1989 | Dipersio et al. |
| 5,012,412 | A | 4/1991 | Helm |
| 5,646,611 | A | 7/1997 | Dailey et al. |
| 6,529,834 | B1 | 3/2003 | Estes et al. |
| 7,028,409 | B2 | 4/2006 | Engebretson et al. |
| 7,080,460 | B2 | 7/2006 | Illfelder et al. |
| 7,103,982 | B2 | 9/2006 | Haugland |
| 7,168,507 | B2 | 1/2007 | Downton |
| 7,327,145 | B2 | 2/2008 | Haugland et al. |

(Continued)

OTHER PUBLICATIONS

Int'l Search Report and Written Opinion in PCT/US2014/042919, dated Oct. 8, 2014.

*Primary Examiner* — Yong-Suk Ro

(74) *Attorney, Agent, or Firm* — Mossman, Kumar & Tyler, PC

(57) ABSTRACT

Measurements made by a near-bit magnetic sensor on a bottomhole assembly are used to determine the azimuth of the BHA. The sensor may be uncalibrated. The measurement may include a cross-axial component of the magnetic field. The method may include estimating the axial component of the near-bit magnetic field using the measurement. The method may include using the estimated azimuth of the BHA for controlling a direction of drilling. The method may include estimating the component Hxy. The method may include correcting the estimated axial component using an offset between a gravitational toolface and a magnetic toolface.

19 Claims, 5 Drawing Sheets

(56) References Cited

U.S. PATENT DOCUMENTS

| | | | | |
|---|---|---|---|---|
| 7,725,263 | B2 | 5/2010 | Sugiura | |
| 8,181,510 | B2 | 5/2012 | Alfred et al. | |
| 8,185,312 | B2 | 5/2012 | Ekseth et al. | |
| 8,360,171 | B2 | 1/2013 | Boone et al. | |
| 8,393,413 | B2 | 3/2013 | Weston et al. | |
| 8,427,162 | B2 | 4/2013 | Bespalov et al. | |
| 8,428,879 | B2 | 4/2013 | Ekseth et al. | |
| 8,433,519 | B2 | 4/2013 | Ekseth et al. | |
| 2004/0050590 | A1 | 3/2004 | Pirovolou et al. | |
| 2008/0053705 | A1 | 3/2008 | Aronstam et al. | |
| 2008/0230273 | A1 | 9/2008 | Brooks | |
| 2010/0300756 | A1 | 12/2010 | Bergstrom et al. | |
| 2011/0147083 | A1* | 6/2011 | Mauldin ..... | E21B 44/00 175/50 |
| 2011/0155467 | A1 | 6/2011 | Gibb et al. | |
| 2011/0196612 | A1 | 8/2011 | Bonavides et al. | |

* cited by examiner

PHASE ESTIMATION FROM ROTATING SENSORS TO GET A TOOLFACE

CROSS-REFERENCE TO RELATED APPLICATIONS

This application claims priority from U.S. Provisional Application Ser. No.:61/836,488, filed Jun. 18, 2013, the entire disclosure of which is incorporated herein by reference in its entirety.

BACKGROUND OF THE DISCLOSURE

This invention relates generally to bottom hole assemblies for drilling wellbores and more particularly to the use of magnetometers and other sensors to determine wellbore direction during the drilling of the wellbores.

To obtain hydrocarbons such as oil and gas, wellbores (also referred to as boreholes) are drilled by rotating a drill bit attached at the end of a drilling assembly generally referred to as the "bottom hole assembly" (BHA) or the "drilling assembly." A large portion of the current drilling activity involves drilling highly deviated and substantially horizontal wellbores to increase production (e.g., hydrocarbon production) and/or to withdraw additional fluids from the earth's formations. In the case of hydrocarbon wells, the wellbore path of such wells is carefully planned prior to drilling such wellbores utilizing seismic maps of the earth's subsurface and well data from previously drilled wellbores in the associated oil fields. Due to the very high cost of drilling such wellbores and the need to precisely place such wellbores in the reservoirs, it is desirable to frequently determine the position and direction of the drilling assembly and thus the drill bit during drilling of the wellbores. Such information is utilized, among other things, to monitor and adjust the drilling direction of the wellbores. It should be noted that the terms "wellbore" and "borehole" are used interchangeably in the present document.

SUMMARY OF THE DISCLOSURE

In aspects, the present disclosure is related to methods, systems, and devices for estimating a near bit rotating azimuth of a bottomhole assembly (BHA) using magnetometer sensors in the steering unit of the BHA.

One embodiment according to the present disclosure may include a method of estimating an orientation of a bottomhole assembly (BHA) in a borehole intersecting an earth formation. The method includes estimating a near-bit azimuth of the BHA using an axial component of a magnetic field estimated from a non-axial component of the magnetic field. The method may include obtaining the non-axial component using a measurement from an uncalibrated magnetic sensor on the BHA. The uncalibrated magnetic sensor may be a near-bit magnetometer. The measurement may comprise a cross-axial component of the magnetic field. The method may include estimating the azimuth using an additional measurement of the magnetic field remote from the bit. The method may include estimating the near-bit azimuth using at least one of: i) a scale factor determined from a measurement of the magnetic field at a magnetometer remote from the bit while the BHA is at a borehole depth and a measurement of the magnetic field from a near-bit magnetometer while the BHA is at the borehole depth; ii) a scale factor determined from a measurement of the magnetic field at a magnetometer remote from the bit at a borehole depth and a measurement of the magnetic field from a near-bit magnetometer at the borehole depth; and iii) a scale factor determined from a measurement of the magnetic field from a near-bit magnetometer at a borehole depth and axial field strength at the steering unit estimated as a function of total magnetic field strength (HTA), a magnetic dip angle (DIPA), near-bit inclination (INCA), and an azimuth orientation of the steering unit. The magnetic field may be the earth magnetic field. The method may include detecting a trend in near-bit azimuth change over time using the estimated near-bit azimuth. The method may include using the trend to identify azimuthal walk. The method may include using the estimated near-bit azimuth of the BHA for controlling a direction of drilling. The method may include estimating the axial component of the near-bit magnetic field using the measurement. The method may include estimating the component Hxy. The method may include correcting the estimated axial component using an offset between a gravitational toolface and a magnetic toolface.

Another embodiment according to the present disclosure may include an apparatus for conducting drilling operations. The apparatus may include a bottomhole assembly (BHA) configured to be conveyed into a borehole; at least one near-bit magnetic sensor on the BHA; and at least one processor configured to estimate a near-bit azimuth of the BHA using an axial component of a magnetic field estimated from a non-axial component of the magnetic field derived from a measurement of the sensor. The at least one near-bit magnetic sensor is configured to provide a signal responsive to a cross-axial component of the magnetic field. The at least one processor may be further configured to estimate the near-bit azimuth using an additional measurement of the magnetic field remote from the bit. The magnetic field may be the earth magnetic field.

Methods embodiments may include transmitting information about the estimated orientation to a surface location. The information may be transmitted to the surface location by one of: mud pulse telemetry, electromagnetic telemetry, acoustic telemetry, wired drillpipe communication, the wired drill pipe comprising direct electrical transmission, inductive coupling, capacitive coupling or optical transmission. Methods may include sending at least one command to the drilling BHA, in response to the received information about the BHA orientation. Methods may include changing at least one drilling parameter on surface, in response to the received information about the BHA orientation, the parameter chosen from a group of weight on bit, drilling fluid flow rate, drill string rotational speed.

Other embodiments may include a non-transitory computer-readable medium product accessible to at least one processor, the computer readable medium including instructions that enable the at least one processor to estimate a near-bit azimuth of the BHA using an axial component of a magnetic field estimated from a non-axial component of the magnetic field. The computer-readable medium product may include at least one of: (i) a ROM, (ii) an EPROM, (iii) an EEPROM, (iv) a flash memory, and (v) an optical disk.

BRIEF DESCRIPTION OF THE DRAWINGS

For detailed understanding of the present disclosure, references should be made to the following detailed description of specific embodiments, taken in conjunction with the accompanying drawings, in which like elements have been given like numerals, wherein.

DETAILED DESCRIPTION OF THE DISCLOSURE

Figure 1:
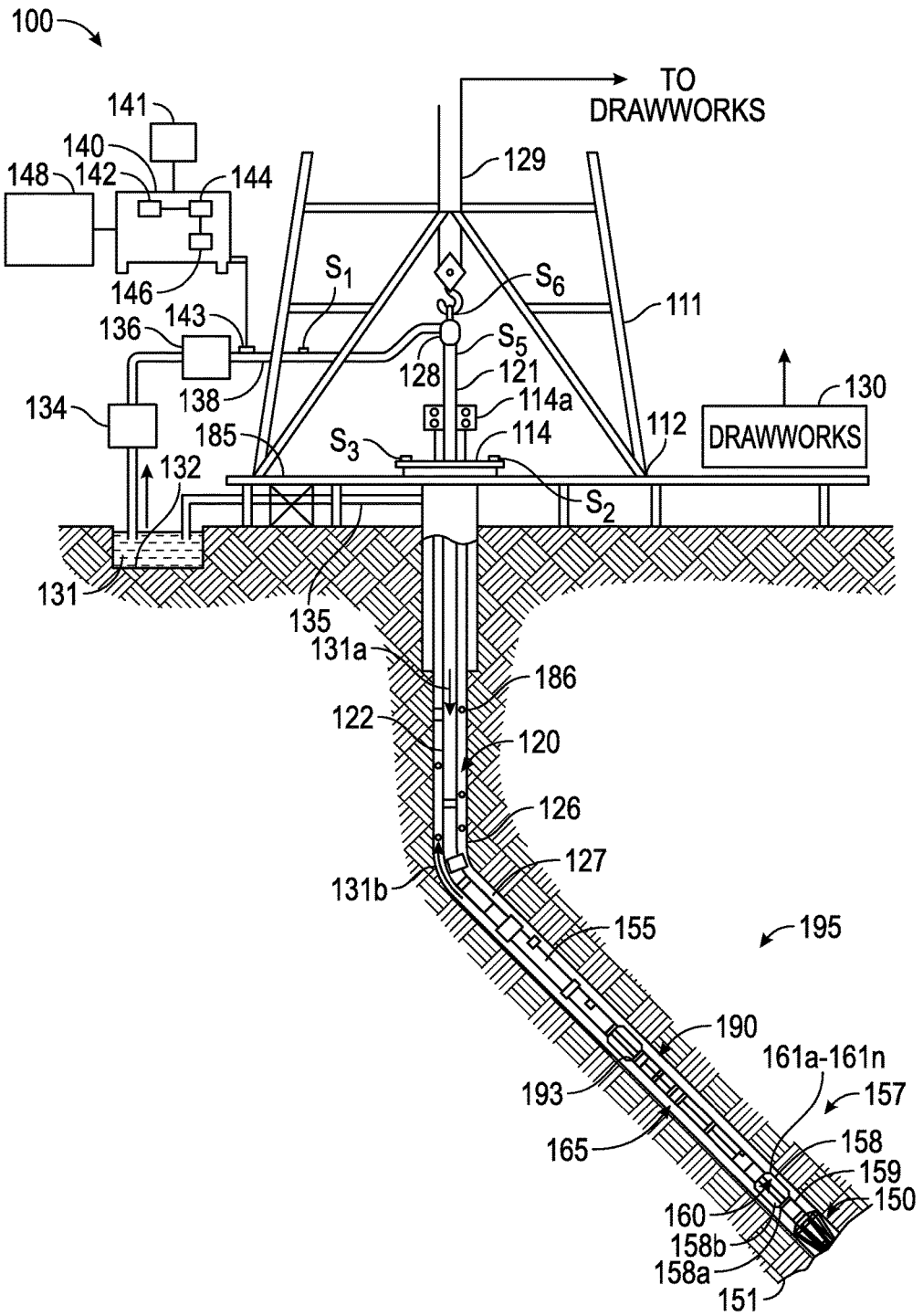
FIG. 1 shows a schematic of a downhole tool deployed in a borehole along a drill string according to one embodiment of the present disclosure.

In commonly used drilling assemblies, the directional package often includes a set of accelerometers and a set of magnetometers, which respectively measure the earth's gravitational and magnetic fields. Traditionally, the drilling assembly may be held stationary during the taking of survey measurements from the accelerometers and the magnetometers. Currently, magnetometers in a Measurement-While-Drilling (MWD) sensor unit (MWDU) may take measurements during drilling operations. The toolface and the inclination angle may be determined from the accelerometer measurements. The azimuth may be determined from the magnetometer measurements in conjunction with the tool face and inclination angle. As used herein, the term "toolface" means the orientation angle of the bent housing or sub in the borehole with respect to a reference such as high side of the borehole which indicates the direction in which the borehole will be curving. In case of drilling with a rotary steerable drilling tool, the term "toolface" means the orientation of a reference feature of the steering tool, e.g. one of the steering ribs on a non-rotating sleeve, with respect to another reference such as high side of the borehole, which is used to determine the desired distribution of steering forces for deflecting the borehole in a desired direction. The inclination angle is the angle between the borehole axis and the vertical (direction of the gravity field). The azimuth is the angle between the horizontal projection of the borehole axis and a reference direction such as magnetic north or absolute north.

Some tools, such as tools used in connection with small tool size BHAs (e.g. 4.75 inch diameter) and high build-up rate tools are prone to deflections and azimuthal walk. Azimuthal walk may be especially problematic in such tools due to the lack of a near-bit azimuth sensor enabling early detection of an unwanted azimuthal drift or closed-loop azimuth control. Without the early detection of walk enabled by provision of a near-bit azimuth value, tools can create considerable doglegs of several degrees before it is possible to detect the deflection using a rotating azimuth measurement in the MWD or with survey measurements. The near-bit azimuth as used herein means the azimuth of the BHA, or a segment thereof (e.g., a sub), at position on the BHA in the near-bit region. Since the BHA may be quite flexible, there may be an azimuthal lag between a near-bit region, such as, for example, the steering unit (SU), and the MWDU of up to 5 degrees. Thus, it is desirable to obtain the near-bit azimuth while drilling.

A near bit rotating azimuth measurement would traditionally be implemented as a near-bit calibrated magnetometer that is pointing in direction of the tool axis (z-magnetometer). Integration of such a sensor into a steering unit (SU) is problematic because the magnetic bit would be attached directly below the SU, conflicting with the magnetic spacing requirements, and further due to space limitations on current tools. Use of a z-sensor may also entail additional magnetic calibration of the SU.

Aspects of the present disclosure include rotating azimuth calculations based on a non-axial measurement from a near-bit magnetometer. Such magnetometers may be found at the SU. Method aspects may include estimating an orientation of a BHA in a borehole intersecting an earth formation. The method may include estimating an azimuth of the BHA using an axial component of a magnetic field calculated from a non-axial component of the magnetic field. The non-axial component may be supplied by the non-axial measurement. This information may be used for early detection of azimuthal walk of the BHA.

FIG. 1 is a schematic diagram of an exemplary drilling system 100 that includes a drill string having a drilling assembly attached to its bottom end that includes a steering unit according to one embodiment of the disclosure. FIG. 1 shows a drill string 120 that includes a drilling assembly or bottomhole assembly (BHA) 190 conveyed in a borehole 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 respectively provide information about the torque and the rotational speed of the drill string 120. Tubing injection speed is determined from the sensor $S_5$, while the sensor $S_6$ provides the hook load of the drill string 120.

In some applications, the drill bit 150 is rotated by only rotating the drill pipe 122. However, in many other applications, a downhole motor 155 (mud motor) disposed in the drilling assembly 190 also rotates the drill bit 150. The rate of penetration (ROP) for a given BHA largely depends on the WOB or the thrust force on the drill bit 150 and its rotational speed.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165. The BHA 190 may further include a variety of other sensors and devices 159 for determining one or more properties of the BHA 190 (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.) For convenience, all such sensors are denoted by numeral 159.

The BHA 190 may include a steering apparatus or tool 158 for steering the drill bit 150 along a desired drilling path. In one aspect, the steering apparatus may include a steering unit 160, having a number of force application members 161*a*-161*n*. The force application members may be mounted directly on the drill string, or they may be at least partially integrated into the drilling motor. In another aspect, the force application members may be mounted on a sleeve, which is rotatable about the center axis of the drill string. The force application members may be activated using electro-mechanical, electro-hydraulic or mud-hydraulic actuators. In yet another embodiment the steering apparatus may include a steering unit 158 having a bent sub and a first steering device 158*a* to orient the bent sub in the wellbore and the second steering device 158*b* to maintain the bent sub along a selected drilling direction. The steering unit 158, 160 may include near-bit inclinometers and magnetometers.

The drilling system 100 may include sensors, circuitry and processing software and algorithms for providing information about desired dynamic drilling parameters relating to the BHA, drill string, the drill bit and downhole equipment such as a drilling motor, steering unit, thrusters, etc. Many current drilling systems, especially for drilling highly deviated and horizontal wellbores, utilize coiled-tubing for conveying the drilling assembly downhole. In such applications a thruster may be deployed in the drill string 190 to provide the required force on the drill bit.

Exemplary sensors include, but are not limited to drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling, and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED.

The drilling system 100 can include one or more downhole processors at a suitable location such as 193 on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. The surface processor 142 can process the surface measured data, along with the data transmitted from the downhole processor, to evaluate formation lithology. While a drill string 120 is shown as a conveyance device for sensors 165, it should be understood that embodiments of the present disclosure may be used in connection with tools conveyed via rigid (e.g. jointed tubular or coiled tubing) as well as non-rigid (e.g. wireline, slickline, e-line, etc.) conveyance systems. The drilling system 100 may include a bottomhole assembly and/or sensors and equipment for implementation of embodiments of the present disclosure on either a drill string or a wireline. A point of novelty of the system illustrated in FIG. 1 is that the surface processor 142 and/or the downhole processor 193 are configured to perform certain methods (discussed below) that are not in prior art.

Steering units in downhole tools may have uncalibrated magnetometers which measure the earth magnetic field in the cross-axial plane. These measurements may be used for calculating the tool rpm or the magnetic toolface. Aspects of the present disclosure use these measurements to estimate a near-bit azimuth.

A suitable rotating azimuth (ROTAZ) measurement is known in the art, but uses measurements from an MWD z-magnetometer outside of the near-bit region. An axial measurement of the magnetic field taken with the z-magnetometer is used for the rotating azimuth calculation. The MWD sensors (e.g., the MWD z-magnetometer) may be as far as 6 to 10 meters uphole of the steering unit, or farther. Thus, use of the MWDU magnetometer does not allow for early detection of an azimuthal bit deflection (azimuthal walk).

The axial field strength at the steering unit (HZA) is a function of the total magnetic field strength (HTA) in the specific area, the magnetic dip angle (DIPA), the current inclination (INCA) and the azimuth orientation of the steering unit (AZMA).

$$HZA = HTA * \{[\cos(DIPA) * \sin(INCA) * \cos(AZMA)] + [\sin(DIPA) * \cos(INCA)]\}$$

HTA and DIPA are constant values which can either be programmed at the surface before running in-hole or measured (e.g., with MWD sensors). The inclination INCA can be measured with a near bit inclination sensor. So, if the axial magnetic field strength HZA is known, the equation can be solved for the near bit azimuth AZMA.

$$AZMA = \text{ARCCOS} \times \left(\frac{HZA - HTA \times \text{SIN}(DIPA) \times \text{COS}(INCA)}{HTA \times \text{COS}(DIPA) \times \text{SIN}(INCA)}\right)$$

This formular can also be noted as follows:

$$azi = arcos\left(\frac{Hz - Htotal\sin(dip)\cos(inc)}{Htotal\cos(dip)\sin(inc)}\right)$$

Embodiments of the present disclosure include estimating an azimuth of the BHA using a near-bit cross-axial measurement. The measurement may include a cross-axial component of the magnetic field. The measurement may be from an uncalibrated magnetic sensor on the BHA. The uncalibrated magnetic sensor may be a near-bit magnetometer in the SU. Embodiments described herein use the cross-axial components to estimate the axial component of the near-bit magnetic field, which may be considered a virtual z-magnetometer measurement. This virtual measurement may used in conjunction with prior art ROTAZ algorithms to calculate the near-bit azimuth of the BHA.

Figure 2:
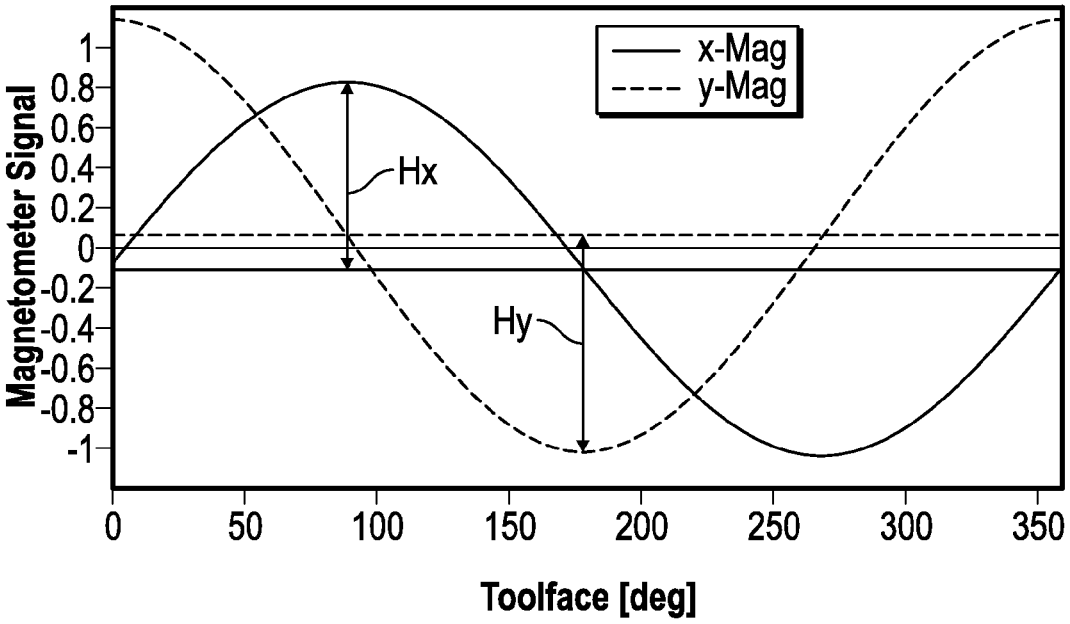
FIG. 2 shows measurements from cross-axial magnetometers for one embodiment according to the present disclosure.

Referring to FIG. 2, when the tool is rotating, measurements from cross axial magnetometers (e.g., an x-magnetometer and a y-magnetometer) may take the form a sine signal (Hx and Hy, respectively) with a period length corresponding to one tool rotation. Both signals have a 90° phase shift. If the magnetometers are not calibrated, the sine signals may have a scale as well as a bias error. The bias error may be readily corrected, since it is known that the measured cross axial magnetic field has a zero mean value for one rotation.

The virtual axial magnetic field (Hz) may be calculated using the amplitudes (Hx and Hy) of the sine signals. Hx and Hy are used to calculate the absolute value Hxy of the cross-axial magnetic field. Assuming substantially no noise and no scale error, Hx=Hy=Hxy. So Hxy can either be calculated by $$Hxy=(Hx+Hy)/2$$

or by simply taking one value Hxy=Hx or Hxy=Hy. A particular signal may be used when the other signal is subject to error. For example, if one sensor or signal is disturbed by contaminating fields (e.g., the power draw of the steering unit) then the other signal may be used.

The near-bit magnetometer may be calibrated using known methods before use in the borehole. However, the magnetometer may become uncalibrated over the course of use. For example, rotation of a ferromagnetic material may cause magnetization of materials in the tool, resulting in the loss of calibration. Alternatively, particular implementations of the SU may opt to use a magnetometer which is uncalibrated at the outset of drilling. Uncalibrated as used herein means that measurements using the magnetometer produce scale error which is not insubstantial. For example, an error below 10 nanotesla (nT), in an earth magnetic field of 46000 nT, may be considered insubstantial.

If the cross-axial magnetometers are not calibrated, Hxy may have a significant scale error. One possible approach for the scale correction is to determine a scaling factor at every survey station which scales the Hxy signal to a cross axial field that has been previously measured by the MWD (e.g., Hxy_Survey). This approach implies that the cross axial magnetic field Hxy_Survey at the survey station is substantially equal to the cross axial magnetic field Hxy that is measured in the steering unit. It is also assumed that the scaling factor is not changing in-between surveys. However, as described above, the BHA may be flexible, and there may be an azimuthal lag between steering unit (SU) and MWDU of up to 5 degrees. Hx and Hy of the two sets of measurements may therefore be oriented differently with respect to the ambient magnetic field. Thus, due to the azimuth delta between SU and MWD, the determined scaling factor may be dependent on the current tool orientation. Moreover, if the scaling factor is calculated using Hxy_Survey, the scaling factor may be reset each time a new survey is taken. This leads to discontinuities in absolute near-bit azimuth values.

Although the scaling factor may be less sensitive than the azimuth to differences in orientation between the SU and MWDU sensors (and may be sufficiently accurate for use with some applications), a more accurate scaling factor may be derived by pairing measurements using the MWDU magnetometers and SU magnetometers according to the depth. SU Hxy values may be stored with an associated depth of measurement. The scale correction factor may similarly calculated at every survey station, but using instead the SU Hxy value that was measured when the SU had been at the current MWDU depth. Such calculations may be performed at the surface or in the tool with results optionally transmitted to the surface.

$$\text{Scale_(depth_corrected)}=Hxy\text{_Survey}/Hxy\text{_(from current } MWD \text{ depth)}$$

Calculation of the near-bit axial component Hz may employ the total magnetic field strength Htotal, which may be obtained from survey measurements, and the scale- and offset-corrected value for Hxy.

$$Hz=\text{sqrt}(H\text{total}^2-Hxy^2).$$

The calculated virtual sensor signal Hz is always positive. For this reason, the mathematical sign has to be corrected before it can be fed into the ROTAZ algorithm. A possible approach for the sign correction is to simply use the sign of the axial magnetic field of the MWD magnetometer. However, due to the spacing between MWD and SU the sign correction can be erroneous close to the borderline because of the azimuthal lag between SU and MWD. The sign changes at a boundary line defined by $$inc = -\arctan\left(\frac{\tan(dip)}{\cos(azi)}\right).$$

If for example the SU has just crossed that line but the MWD has not, the algorithm uses the wrong sign from the MWD. This results in a zone where the algorithm is not reliable. For an inclination of 90 degrees, the unreliable zone is when drilling due east or due west.

The ROTAZ algorithm may be sensitive to measurement noise when drilling due north or due south, as is apparent from the arccos function (FIG. X(2)), where the absolute value for the argument is close to 1. An ambiguity exists in the azimuth solution, because the arccos argument is axially symmetrical to the north-south axis. Therefore, the algorithm gives two solutions. One solution is valid for the upper half plane and the other one is valid for the lower half plane. A solution must be chosen, for example, based on the survey measurements.

Some embodiments may combine the techniques described above with an alternative approach to calculate a near bit azimuth. The alternative approach may be based on the offset between gravity tool face and magnetic toolface. The alternative approach has a different unreliable zone. So, a combination of these algorithms could improve the accuracy of the calculated near bit azimuth and would minimize the 'no go' regions where the measurement is not reliable or not possible due to the measurement principle.

Figure 3:
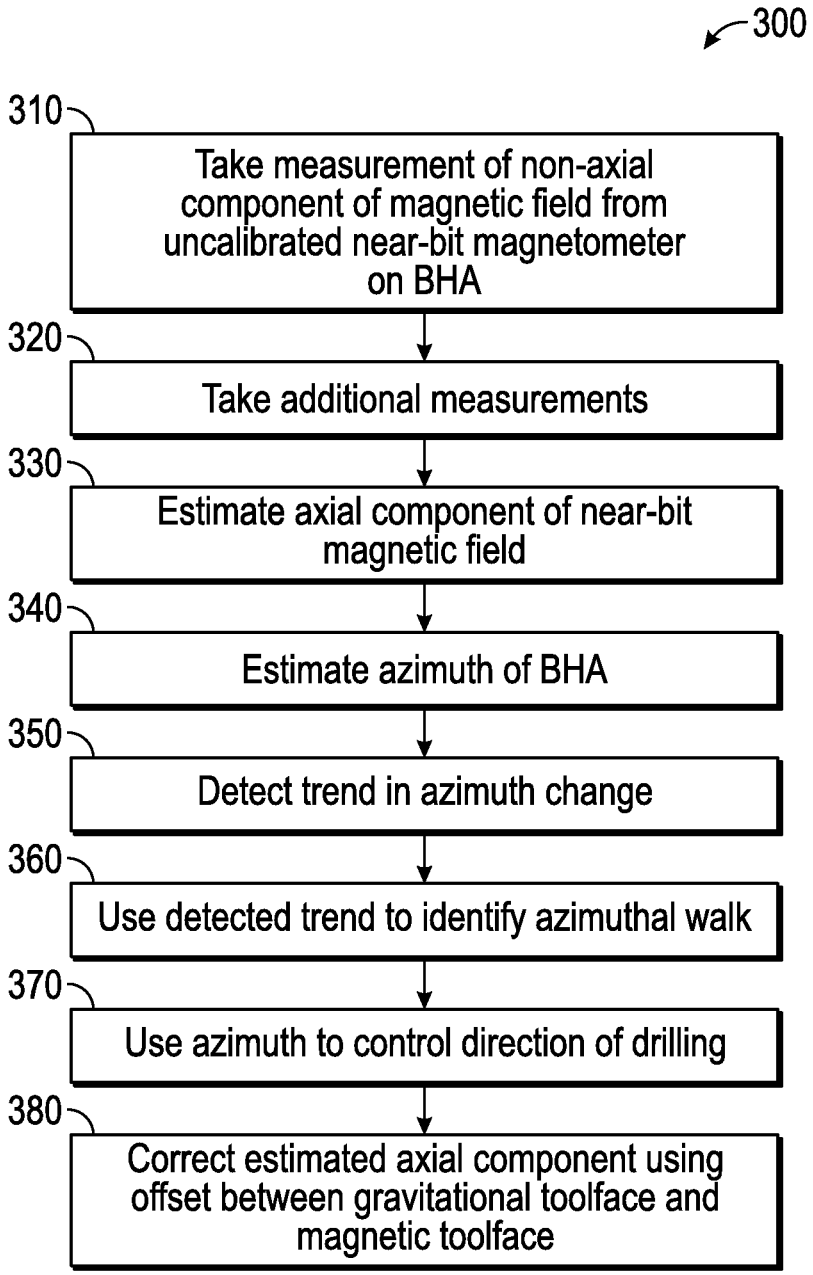
FIG. 3 shows a flow chart for a method for one embodiment according to the present disclosure.

FIG. 3 shows a flow chart 300 for estimating an orientation of a bottomhole assembly (BHA) in a borehole intersecting an earth formation according to one embodiment of the present disclosure. In optional step 310, a measurement of a non-axial component of an ambient magnetic field is taken from an uncalibrated near-bit magnetometer on the BHA. The near-bit magnetometer may be at the SU. Optional step 320 includes taking one or more additional measurements of the ambient magnetic field from the BHA. Step 330 includes estimating the axial component of the near-bit magnetic field using measurement and possibly the additional measurement. Step 340 includes estimating an azimuth of the BHA using the axial component. Step 340 may include estimating the azimuth using the additional measurement. Step 350 may include detecting a trend in azimuth change over time using the estimated near-bit azimuth. Step 360 may include using the detected trend to identify azimuthal walk. Step 370 may include using the estimated azimuth of the BHA for controlling a direction of drilling. Optional step 380 may include correcting the estimated axial component using an offset between a gravitational toolface and a magnetic toolface.

Figure 4:
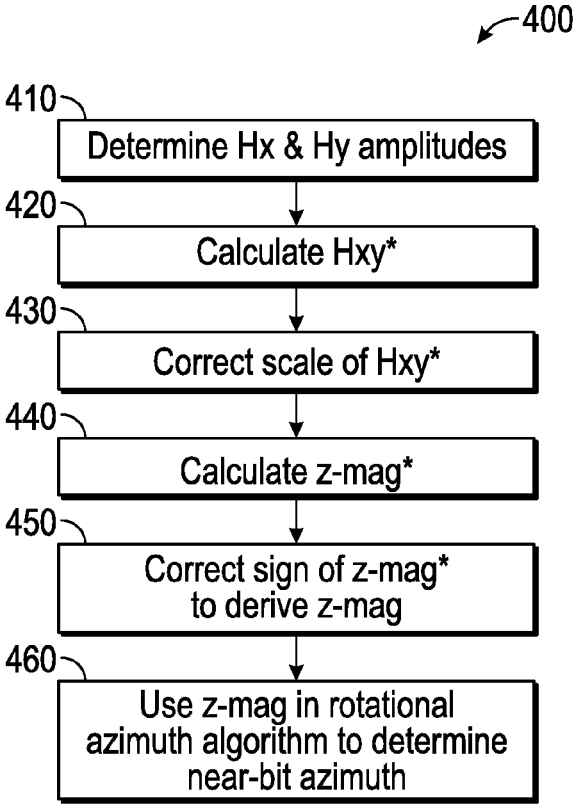
FIG. 4 shows a flow chart for another method for one embodiment according to the present disclosure.

FIG. 4 shows a flow chart 400 for estimating a near-bit azimuth of the BHA. Step 410 includes determining absolute amplitudes of Hx and Hy. Step 420 includes calculating Hxy*. For example, step 420 may be carried out using the formula $Hxy^*=sqrt(Hx^2+Hy^2)$. Step 430 includes correcting the scale of Hxy* using additional measurements from the MWDU, resulting in Hxy. Step 440 includes calculating the virtual z-magnetometer signal, z-mag*. Step 450 includes correcting the sign of z-mag* using measurements from the MWDU, resulting in z-mag. In step 460, z-mag is then used in the ROTAZ algorithm to determine the near-bit azimuth.

Figure 5A:
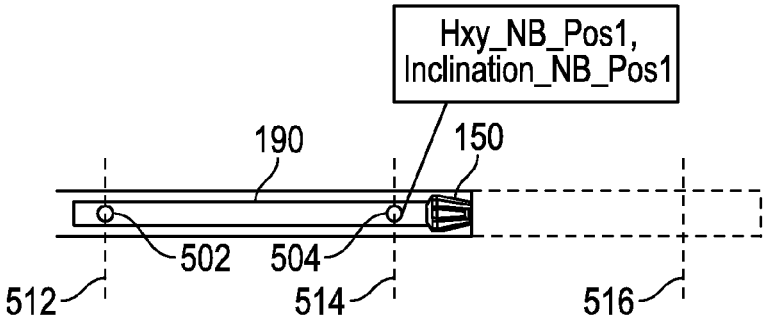
FIGS. 5A & 5B shows a schematic for correcting the scale of a non-axial component using an additional measurement from a sensor remote from the bit.
Figure 5B:
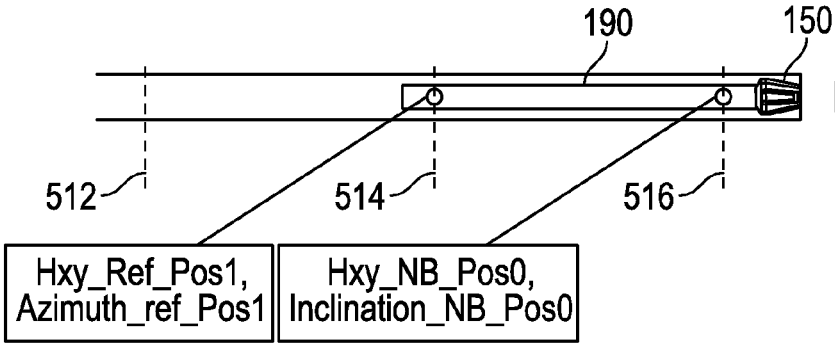

FIGS. 5A & 5B illustrate techniques for correcting the scale of Hxy* using additional measurements from the MWDU. Drilling assembly 190 in borehole 126 has a drill bit 150 attached at its distal end. Drilling assembly 190 also includes MWDU magnetometer 502 and SU magnetometer 504. As the drill bit 150 drills the borehole 126, it disintegrates the formation while extending the borehole and traveling into the formation. In FIG. 5A, the drill bit 150 is at a first borehole depth which positions the MWDU magnetometer 502 at a first borehole depth 512 and SU magnetometer 504 at a second borehole depth 514. In FIG. 5B, the drill bit 150 is at a greater borehole depth which positions the MWDU magnetometer 502 at a second borehole depth 514 and SU magnetometer 504 at a third borehole depth 516. The second borehole depth 514 may be referred to as position 1 and the third borehole depth may be referred to as position 0.

Some embodiments may include using a scale factor for Hxy* determined by dividing the Hxy measurement from the MWDU magnetometer 502 at the second borehole depth 514 ('Hxy_Ref_Pos1') by the measurement from SU magnetometer 504 at the third borehole depth 516 ('Hxy_NB_Pos0'). Some embodiments may include using a scale factor determined by dividing the Hxy measurement from the MWDU magnetometer 502 at the second borehole depth 514 ('Hxy_Ref_Pos1') by the SU magnetometer 504 at the second borehole depth 514 ('Hxy_NB_Pos1'). Alternatively, the scale factor may be determined by dividing HZA (described above) by the measurement from SU magnetometer 504 at the third borehole depth 516 ('Hxy_NB_Pos0'). The following pseudocode illustrates the embodiments:

Scale1 = *Hxy_Ref_Pos*1/*Hxy_NB_Pos*0;

Scale2 = *Hxy_Ref_Pos*1/*Hxy_NB_Pos*1

Scale3 = *Hxy*(*dip*,*H*total,Azimuth_*Ref_Pos*1,Inclination_*NB_Pos*0)/*Hxy_NB_Pos*0.

Combinations or statistical derivations of these scale factors (and others), with or without weighting, may also be used.

The processing of the data may be done by a downhole processor that provides the near-bit angle substantially in real-time enabling prompt decisions on controlling the drilling direction. Additionally or alternatively, part or all of the processing may be carried out at the surface. The near-bit azimuth provided by the method described above may also be used in evaluating directionally sensitive measurements made by formation evaluation sensors on the BHA. These include gamma ray, density, resistivity, and acoustic images of the borehole. Such measurements are also used in imaging of the borehole wall. Implicit in the control and processing of the data is the use of a computer program on a suitable machine readable-medium that enables the processors to perform the control and processing. The machine-readable medium may include ROMs, EPROMs, EEPROMs, flash memories and optical disks.

Figure 6:
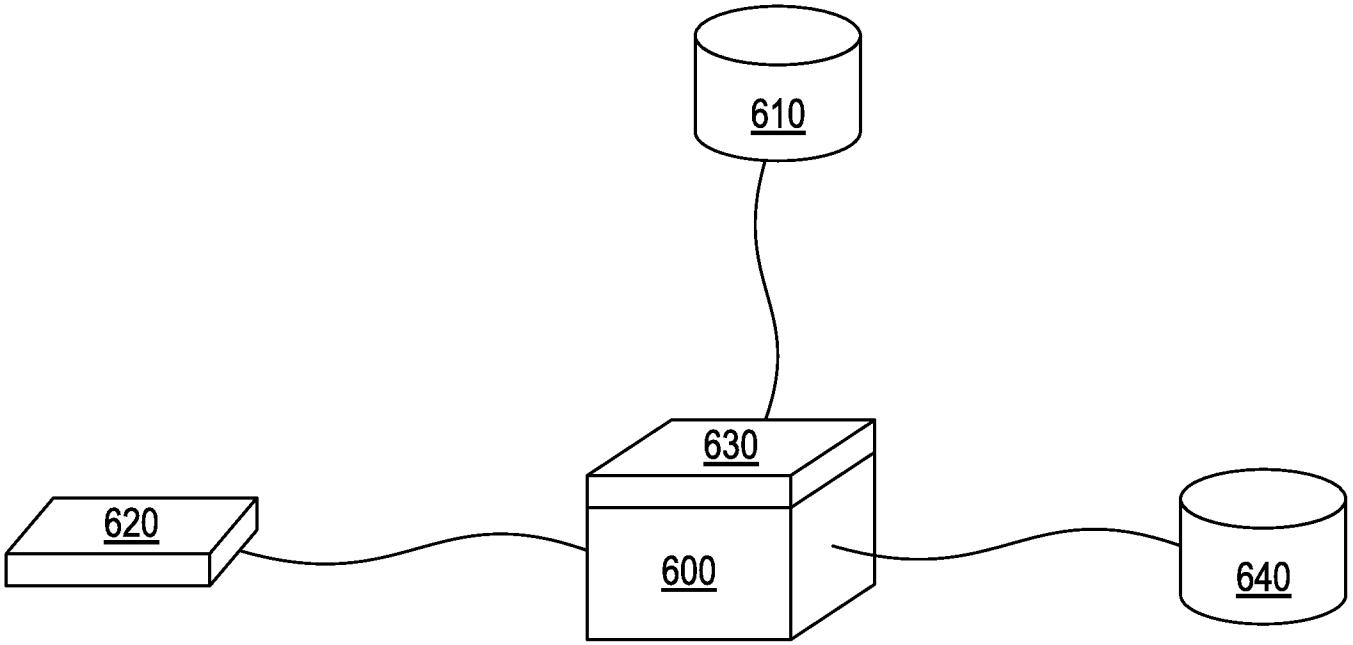
FIG. 6 shows a schematic of a hardware environment for implementing one embodiment of the method according to the present disclosure.

As shown in FIG. 6, certain embodiments of the present disclosure may be implemented with a hardware environment that includes an information processor 500, a information storage medium 610, an input device 620, processor memory 630, and may include peripheral information storage medium 640. The hardware environment may be in the well, at the rig, or at a remote location. Moreover, the several components of the hardware environment may be distributed among those locations. The input device 620 may be any information reader or user input device, such as data card reader, keyboard, USB port, etc. The information storage medium 610 stores information provided by the sensors or detectors. Information storage medium 610 may be any standard computer information storage device, such as a ROM, USB drive, memory stick, hard disk, removable RAM, EPROMs, EAROMs, EEPROM, flash memories, and optical disks or other commonly used memory storage system known to one of ordinary skill in the art including Internet based storage. Information storage medium 610 stores a program that when executed causes information processor 600 to execute the disclosed method. Information storage medium 610 may also store the formation information provided by the user, or the formation information may be stored in a peripheral information storage medium 640, which may be any standard computer information storage device, such as a USB drive, memory stick, hard disk, removable RAM, or other commonly used memory storage system known to one of ordinary skill in the art including Internet based storage. Information processor 600 may be any form of computer or mathematical processing hardware, including Internet based hardware. When the program is loaded from information storage medium 610 into processor memory 630 (e.g. computer RAM), the program, when executed, causes information processor 600 to retrieve detector information from either information storage medium 610 or peripheral information storage medium 640 and process the information to estimate a parameter of interest. Information processor 600 may be located on the surface or downhole.

Herein, the term "information" may include, but is not limited to, one or more of: (i) raw data, (ii) processed data, and (iii) signals. The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. As used above, the term "sub" refers to any structure that is configured to partially enclose, completely enclose, house, or support a device. The term "information" as used above includes any form of information (Analog, digital, EM, printed, etc.). The term "information processing device" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions. The term processor is intended to include devices such as a field programmable gate array (FPGA).

"Near-bit" as used herein refers to a region made up of positions closer to the drillbit than the closest MWD sensor. A sensor (or measurement therefrom) may be near-bit when found at the steering unit. Near-bit may be defined as less than 10 meters from the drillbit, less than 6 meters from the drillbit, less than 5 meters from the bit, less than 4 meters from the bit, less than 3 meters from the bit, or closer. An area not in the near-bit region may be referred to as "remote from the bit", and may include, for example positions where an MWD sensor is located.

While the foregoing disclosure is directed to the one mode embodiments of the disclosure, various modifications will be apparent to those skilled in the art. It is intended that all variations be embraced by the foregoing disclosure.

What is claimed is:

1. A method of estimating an orientation of a bottomhole assembly (BHA), the BHA including a drillbit and at least one measurement-while-drilling (MWD) sensor, in a borehole intersecting an earth formation, the method comprising:

obtaining a non-axial component of a magnetic field using a measurement from a magnetic sensor responsive to the magnetic field at a location on the BHA closer to the drillbit than the closest sensor to the drillbit of the at least one MWD sensor;

estimating an axial component of the magnetic field from the non-axial component of the magnetic field; and estimating a near-bit azimuth of the BHA at the location using the axial component of the magnetic field.

2. The method of claim 1 further comprising obtaining the non-axial component using a measurement from an uncalibrated magnetic sensor on the BHA.

3. The method of claim 2 wherein the uncalibrated magnetic sensor is a near-bit magnetometer.

4. The method of claim 2 wherein the measurement comprises a cross-axial component of the magnetic field.

5. The method of claim 1 further comprising estimating the near-bit azimuth using an additional measurement of the magnetic field remote from the bit.

6. The method of claim 5 wherein estimating the near-bit azimuth using the additional measurement comprises applying to the non-axial component at least one of: i) a scale factor determined from a measurement of the magnetic field at a magnetometer remote from the bit while the BHA is at a borehole depth and a measurement of the magnetic field from a near-bit magnetometer while the BHA is at the borehole depth; ii) a scale factor determined from a measurement of the magnetic field at a magnetometer remote from the bit at a borehole depth and a measurement of the magnetic field from a near-bit magnetometer at the borehole depth; and iii) a scale factor determined from a measurement of the magnetic field from a near-bit magnetometer at a borehole depth and axial field strength at the steering unit estimated as a function of total magnetic field strength (HTA), a magnetic dip angle (DIPA), near-bit inclination (INCA), and an azimuth orientation of the steering unit.

7. The method of claim 1 further comprising:

detecting a trend in near-bit azimuth change over time using the estimated near-bit azimuth ; and using the trend to identify azimuthal walk.

8. The method of claim 1 further comprising using the estimated near-bit azimuth of the BHA for controlling a direction of drilling.

9. The method of claim 1 further comprising estimating the axial component of the near-bit magnetic field using an additional measurement of the magnetic field remote from the bit.

10. The method of claim 1 further comprising estimating the component Hxy.

11. The method of claim 1 further comprising correcting the estimated axial component using an offset between a gravitational toolface and a magnetic toolface.

12. The method of claim 1, further comprising transmitting information about the estimated orientation to a surface location.

13. The method of claim 12, where the information is transmitted to the surface location by one of: mud pulse telemetry, electromagnetic telemetry, acoustic telemetry, wired drillpipe communication, the wired drill pipe comprising direct electrical transmission, inductive coupling, capacitive coupling or optical transmission.

14. The method of claim 12, further comprising sending at least one command to the drilling BHA, in response to the received information about the BHA orientation.

15. The method of claim 12, further comprising changing at least one drilling parameter at the surface location, in response to the received information about the BHA orientation, the parameter chosen from a group of: weight on bit, drilling fluid flow rate, and drill string rotational speed.

16. The method of claim 1, wherein the estimating the near-bit azimuth of the BHA is conducted at a surface location.

17. An apparatus for conducting drilling operations, the apparatus comprising:

a bottomhole assembly (BHA) configured to be conveyed into a borehole, the BHA including a drillbit and at least one measurement-while-drilling (MWD) sensor;

at least one magnetic sensor at a location on the BHA closer to the drillbit than the closest sensor to the drillbit of the at least one MWD sensor; and at least one processor configured to:

obtain a non-axial component of a magnetic field using a measurement from the magnetic sensor responsive to the magnetic field;

estimate an axial component of the magnetic field from the non-axial component of the magnetic field; and estimate a near-bit azimuth of the BHA at the location using the axial component of the magnetic field.

18. The apparatus of claim 17 wherein the at least one near-bit magnetic sensor is uncalibrated.

19. The apparatus of claim 17 wherein the at least one near-bit magnetic sensor is configured to provide a signal responsive to a cross-axial component of the magnetic field.

* * * * *